US008000862B2

(12) United States Patent
Morinaga et al.

(10) Patent No.: US 8,000,862 B2
(45) Date of Patent: Aug. 16, 2011

(54) SWING CONTROL DEVICE AND CONSTRUCTION MACHINERY

(75) Inventors: Jun Morinaga, Hiratsuka (JP); Tadashi Kawaguchi, Hiratsuka (JP); Hiroaki Inoue, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 1125 days.

(21) Appl. No.: 11/791,190

(22) PCT Filed: Nov. 16, 2005

(86) PCT No.: PCT/JP2005/021012

§ 371 (c)(1),
(2), (4) Date: May 17, 2007

(87) PCT Pub. No.: WO2006/054581

PCT Pub. Date: May 26, 2006

(65) Prior Publication Data

US 2007/0277986 A1 Dec. 6, 2007

(30) Foreign Application Priority Data

Nov. 17, 2004 (JP) ..... 2004-333677

(51) Int. Cl.
*H02P 21/00* (2006.01)

(52) U.S. Cl. ..... 701/50; 212/255

(58) Field of Classification Search ..... 701/50; 212/255; 318/461, 432, 434, 798, 800
See application file for complete search history.

(56) References Cited

U.S. PATENT DOCUMENTS 5,835,874 A * 11/1998 Hirata et al. ..... 701/50
6,732,458 B2 * 5/2004 Kurenuma et al. ..... 37/348
7,067,999 B2 * 6/2006 Sugano et al. ..... 318/372

FOREIGN PATENT DOCUMENTS

JP 2001-10783 A 1/2001
JP 2001-11897 A 1/2001
JP 2004-169466 A 6/2004

OTHER PUBLICATIONS

Notification Concerning Transmittal of International Preliminary Report on Patentability, Chapter I of the Patent Cooperation Treaty and Written Opinion of the International Searching Authority dated May 22, 2007, for PCT/JP2005/021012. 4 sheets.

* cited by examiner

*Primary Examiner* — Dalena Tran
(74) *Attorney, Agent, or Firm* — Holtz, Holtz, Goodman & Chick PC

(57) ABSTRACT

In a swing control device installed in an electric rotary excavator (a construction machine), when a leading edge or a trailing edge of a lever signal is sharp due to a quick operation of a swing lever, a gradient as a rise time Ta1 or a fall time Tb1 is provided to the leading edge or the trailing edge of the torque output and the acceleration that are output based on the lever signal so as to somewhat ease the edge. With the arrangement, an impact in acceleration or deceleration of a rotary body can be suppressed. Specifically, a gradient in the acceleration operation is provided such that the rise time Ta1 becomes 0.15 seconds or more, while a gradient in the stop deceleration operation is provided such that the fall time Tb1 becomes 0.1 seconds or more.

8 Claims, 12 Drawing Sheets

SWING CONTROL DEVICE AND CONSTRUCTION MACHINERY

This application is a U.S. National Phase Application under 35 USC 371 of International Application PCT/JP2005/021012 filed Nov. 16, 2005.

TECHNICAL FIELD

The present invention relates to a swing control device of a rotary body that is rotated by an electric motor and a construction machine.

BACKGROUND ART

Recently, hybrid electric rotary excavators have been being developed, in which a rotary body is driven by an electric motor and other members such as a work equipment and a carrier are driven by a hydraulic actuator (see, for instance, Patent Document 1).

Since the rotation of the rotary body is driven by the electric motor in such electric rotary excavators, even when the rotary body is rotated while a boom and an arm that are driven hydraulically are lifted up, the rotation of the rotary body is not affected by the lifting of the boom and the arm. Accordingly, an energy loss at control valves or the like can be reduced as compared to an arrangement in which the rotary body is hydraulically driven, thereby enhancing energy efficiency.

[Patent Document 1] JP-A-2001-11897

DISCLOSURE OF THE INVENTION

Problems to be Solved by the Invention

Meanwhile, in the electric rotary excavator, acceleration and deceleration are typically performed using a torque output based on a torque command value that is obtained by a deviation from a comparison between a speed command according to a lever signal from a swing lever and an actual speed. With the arrangement, when a leading edge or a trailing edge of the lever signal is sharp due to a quick operation of the swing lever or the like, the speed command value changes substantially linearly in a short time and the deviation from the actual speed becomes large, which causes a large torque to be suddenly output. Accordingly, the sudden output of the torque also causes a sudden acceleration or deceleration, which likely gives a strong impact to an operator.

An object of the present invention is to provide a swing control device and a construction machine that can reduce an impact in acceleration or deceleration of a rotary body even when a swing lever is operated quickly.

Means for Solving the Problems

A swing control device according to an aspect of the present invention that controls a rotary body rotated by an electric motor provides a predetermined gradient to a leading edge and a trailing edge of a torque output of the electric motor based on a lever signal from a swing lever.

According to the aspect of the present invention, even when a leading edge or a trailing edge of the lever signal becomes sharp due to a quick operation of the swing lever, the gradient is provided to the leading edge or the trailing edge of the torque output that is output based on the lever signal so as to somewhat easing the edge, thereby suppressing acceleration or deceleration causing an impact.

In the swing control device according to the aspect of the present invention, it is preferable that a gradient having a specific magnitude is provided in each of an acceleration operation, a stop deceleration operation and an intermediate deceleration operation of the rotary body.

Note that the acceleration operation refers to a state in which the swing lever is tilted from a neutral position by a predetermined angle; the stop deceleration operation refers to a state in which the swing lever that is tilted by a predetermined angle is returned to the neutral position; and the intermediate deceleration operation refers to a state in which the swing lever that is tilted by a predetermined angle is returned to an arbitrary position before the neutral position.

In addition, a different gradient may be provided in an intermediate acceleration operation where the swing lever that is tilted by a predetermined angle is further tilted.

According to the aspect of the present invention, a specific gradient is provided for each of the acceleration operation, the stop deceleration operation and the intermediate deceleration operation, which can cope with difference in magnitudes of an impact among the operations or a problem unique to an operation.

In the swing control device according to the aspect of the present invention, it is preferable that a maximum acceleration having a specific magnitude is provided in each of the acceleration operation, the stop deceleration operation and the intermediate deceleration operation of the rotary body.

According to the aspect of the present invention, settings of the maximum acceleration (including acceleration in increasing the speed and a negative acceleration in decreasing the speed) are different among the acceleration operation, the stop deceleration operation and the intermediate deceleration operation. For example, by setting the maximum acceleration in the stop deceleration operation to large, the maximum torque to be output also increases, which enhances responsivity in stopping. By setting the maximum acceleration in the intermediate deceleration operation to small, the deceleration can be performed more smoothly.

In the swing control device according to the aspect of the present invention, it is preferable that: a gradient for the leading edge of the torque output in the acceleration operation is provided such that a rise time required when the torque output reaches a maximum value from zero becomes 0.15 seconds or more; a gradient for the trailing edge of the torque output in the stop deceleration operation is provided such that a fall time required when the torque output reaches a maximum value from zero becomes 0.10 seconds or more; and a gradient for the trailing edge of the torque output in the intermediate deceleration operation is provided such that a fall time required when the torque output reaches a maximum value from zero becomes 0.15 seconds or more.

The trailing edge of the torque output in the stop deceleration operation or in the intermediate deceleration operation is generated when a brake torque is applied.

According to the aspect of the present invention, since the gradient in the acceleration is provided such that the rise time becomes 0.15 seconds or more, thereby securely suppressing the impact generated in the acceleration operation. With the rise time shorter than 0.15 seconds, the impact in the acceleration operation may not be securely suppressed. By providing the gradient in the stop deceleration operation such that the fall time becomes 0.1 seconds or more, an impact generated when performing the stop deceleration operation can be securely suppressed. By providing the gradient in the intermediate deceleration operation such that the fall time becomes 0.15 seconds or more, an impact unique to the intermediate deceleration operation can also be securely suppressed.

A construction machine according to another aspect of the present invention includes: a rotary body that is rotated by an electric motor; and the above-described swing control device of the present invention, the swing control device controlling the rotary body.

According to the aspect of the present invention, as described above, the impact in the acceleration or the deceleration of the rotary body can be reduced even when the swing lever is quickly operated.

EXPLANATION OF CODES

1: electric rotary excavator (construction machine)
4: rotary body
5: electric motor
10: swing lever
50: swing control device
Ta1: rise time
Tb1, Tc1: fall time
Ga_max, Gb_max, Gc_max: maximum rotation acceleration

BEST MODE FOR CARRYING OUT THE INVENTION

First Embodiment

[1-1] Overall Arrangement

A first embodiment of the present invention will be described below with reference to the attached drawings.

Figure 1:
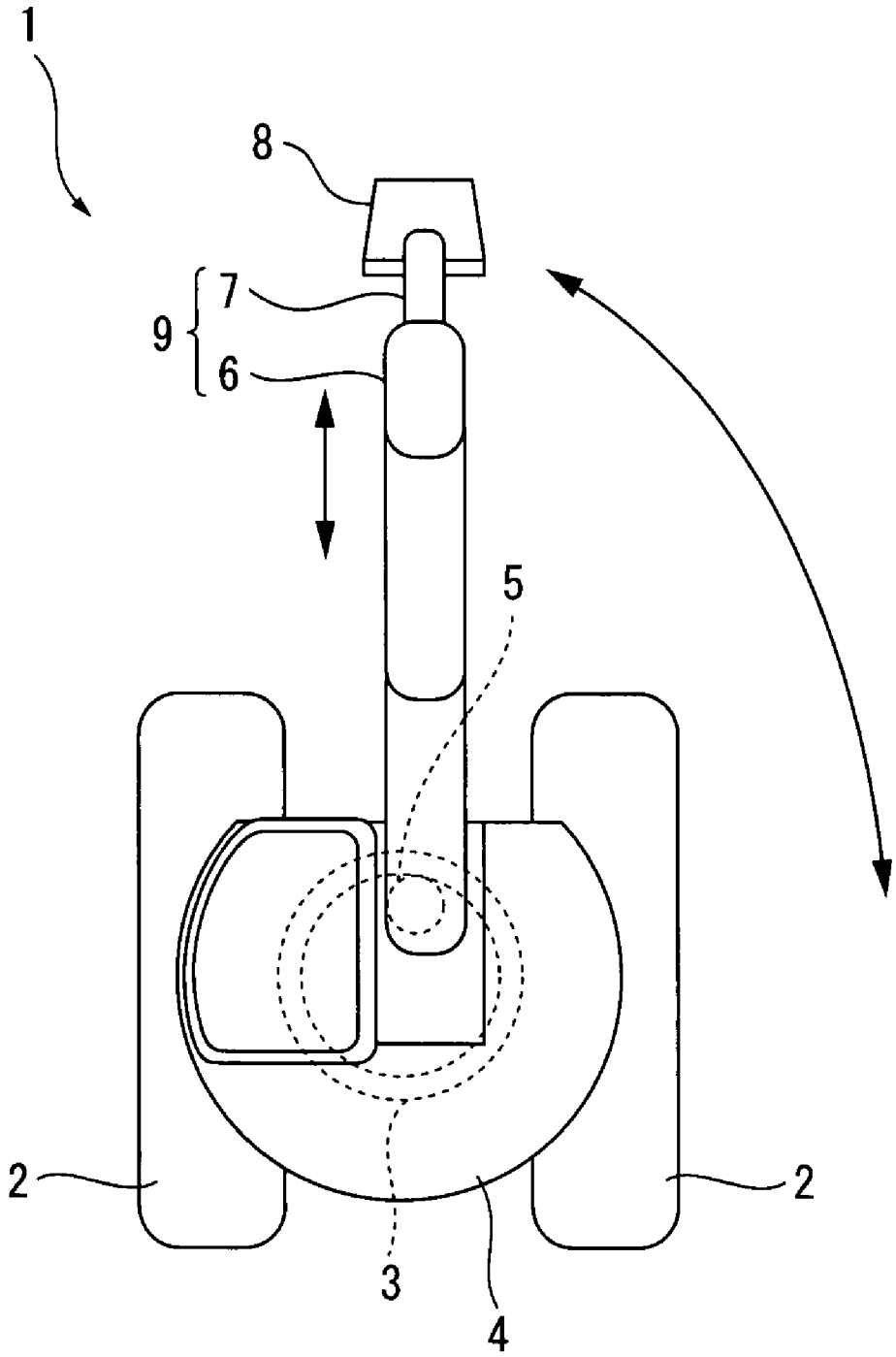
FIG. 1 is a plan view showing a construction machine according to a first embodiment of the present invention.
Figure 2:
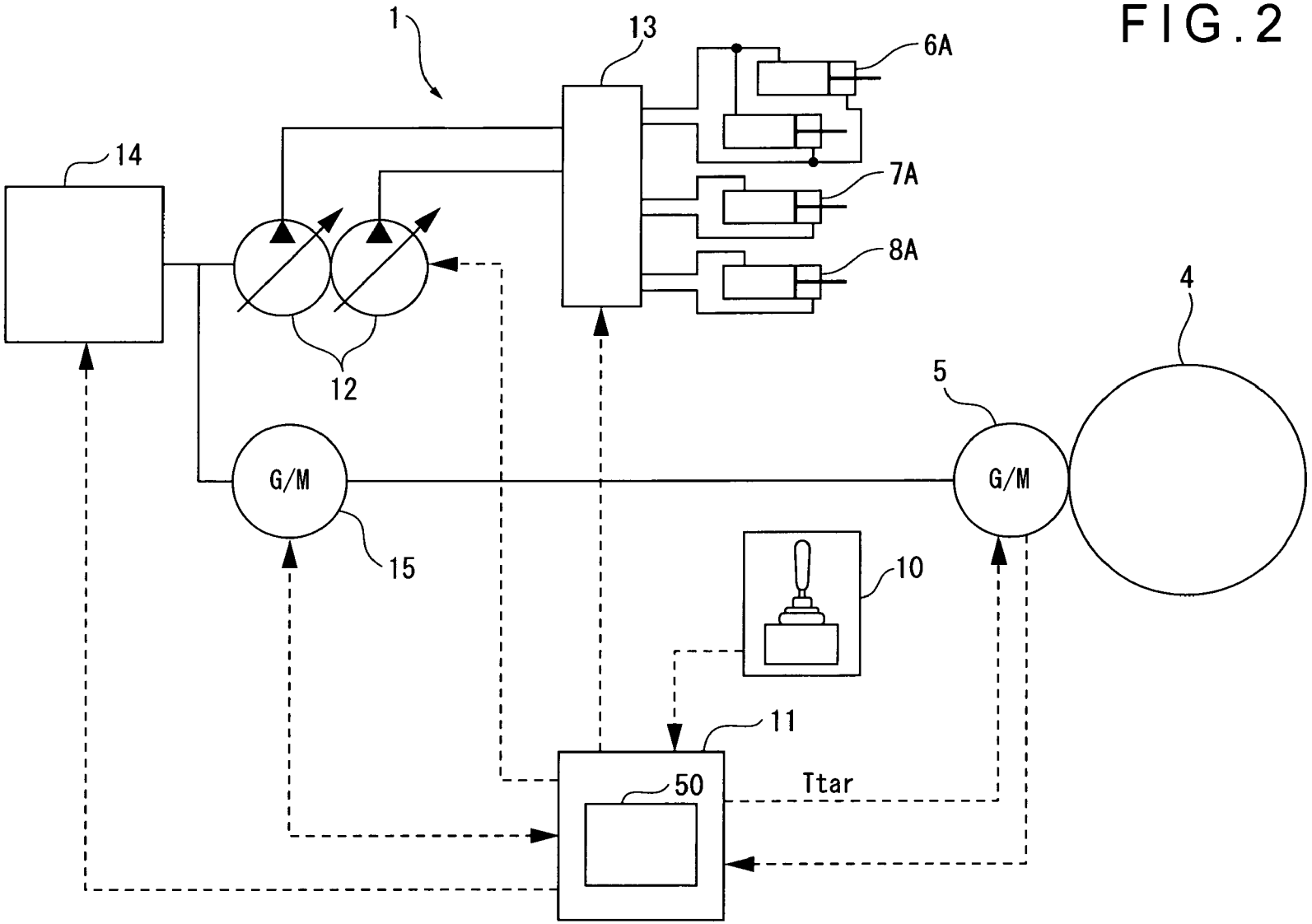
FIG. 2 is an illustration showing an overall arrangement of the construction machine according to the first embodiment.

FIG. 1 is a plan view showing an electric rotary excavator (construction machine) 1 according to the first embodiment. FIG. 2 is an illustration showing an overall arrangement of the electric rotary excavator 1.

In FIG. 1, the electric rotary excavator 1 includes a rotary body 4 that is mounted on a track frame of a base carrier 2 via a swing circle 3, the rotary body 4 rotated by an electric motor 5 that is engaged with the swing circle 3. A power source of the electric motor 5 is a generator 15 (FIG. 2) installed in the rotary body 4, the generator driven by an engine 14 (FIG. 2).

As shown in FIG. 2, the rotary body 4 is provided with a boom 6, an arm 7 and a bucket 8 respectively operated by hydraulic cylinders 6A, 7A and 8A, the components 6, 7 and 8 forming a work equipment 9. A hydraulic source of the hydraulic cylinders 6A, 7A and 8A is a hydraulic pump 12 driven by the engine 14. Accordingly, the electric rotary excavator 1 is a hybrid construction machine having the hydraulically-driven work equipment 9 and the electrically-driven rotary body 4.

Referring to FIG. 2, the electric rotary excavator 1 includes a swing lever 10, a controller 11 and a hydraulic control valve 13 in addition to the components described above.

The swing lever 10 (typically serving also as a work equipment lever for operating the arm 7) outputs a lever signal according to a tilt angle to the controller 11. The controller 11 issues a command to the hydraulic pump 12 and the hydraulic control valve 13 that drives the hydraulic cylinders 6A, 7A, 8A in accordance with a value of the lever signal, thereby controlling a drive of the work equipment 9. The controller 11 issues, as needed, a command for adjusting an engine speed to the engine 14 and a command for adjusting power generation to the generator 15.

The controller 11 controls rotation of the rotary body 4 by controlling a torque output of the electric motor 5. For this purpose, the controller 11 includes a swing control device 50. The swing control device 50 generates a torque command value Ttar for the electric motor 5 in accordance with the lever signal value and an actual speed Vact (FIG. 5) of the electric motor 5 that is detected by a rotation speed sensor (not shown). The torque command value Ttar is output to an inverter (not shown), where the inverter converts the torque command value Ttar to a current value and a voltage value and controls the electric motor 5 to drive at a target speed.

[1-2] Control Structure of Rotation Control Device 50

Now, a control structure of the swing control device 50 will be described through an explanation of a control method.

Conventionally, when a lever signal that is upright substantially at right angle like a rectangular wave is input (e.g., when the swing lever 10 is directly and quickly tilted from a neutral position by a predetermined angle), the speed command value that is linearly increased from "0 (zero)" is generated. A rotation state of the rotary body in such a case is shown in FIG. 3.

Figure 3:
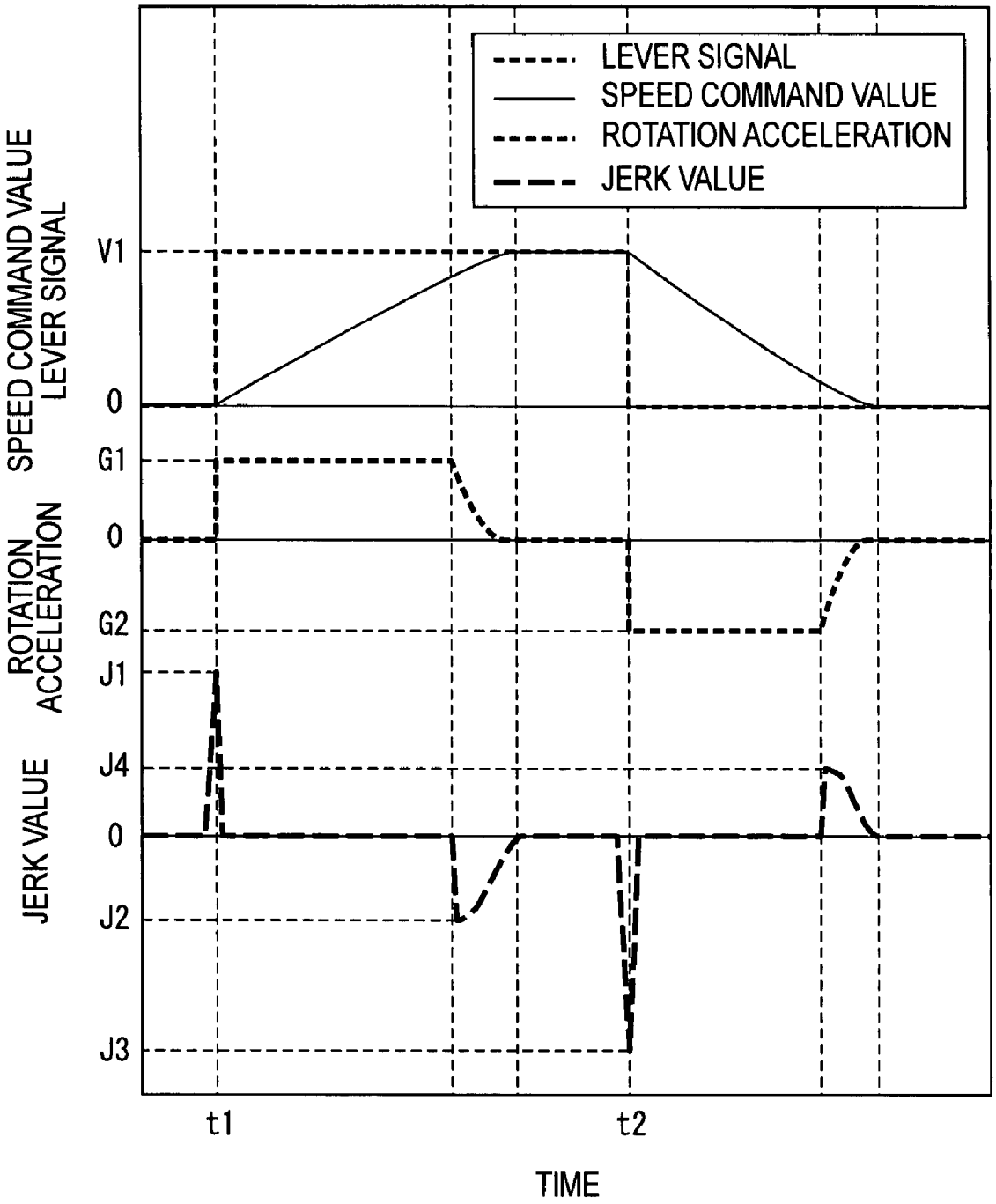
FIG. 3 PRIOR ART
FIG. 3 is a diagram explaining a related art rotation control method.

In FIG. 3, when a lever signal with a sharp leading edge is input (t1) and the speed command value linearly increases, a predetermined rotation acceleration G1 is suddenly generated simultaneously with generation of the speed command value, and the rotary body 4 is rotated with the rotation acceleration G1. The speed command value slightly becomes gentle due to gain characteristics immediately before reaching a speed value V1 according to the lever signal and then becomes substantially constant at the speed value V1. Accordingly, the rotation acceleration falls gently and becomes zero when the speed command value becomes constant.

When the swing lever 10 is directly and quickly returned to the neutral position from the constant rotation state at the constant speed command value, the trailing edge of the lever signal becomes sharp (t2) and the speed command value is generated so as to decrease linearly.

In such a case, a predetermined acceleration G2 on a speed-decrease side is suddenly generated simultaneously with the linear decrease of the speed command value and the brake is applied to the rotary body 4 at the predetermined rotation acceleration G2, in a manner opposite to the above case. The speed command value slightly becomes gentle due to the gain characteristics immediately before reaching zero according to the lever signal and then becomes zero. Accordingly, the rotation acceleration also rises gently and becomes zero in a short time.

Meanwhile, in the related art control, when the acceleration or the deceleration is performed by a quick operation of the swing lever 10, the rotation acceleration is suddenly generated. Accordingly, peak amounts J1 to J4 of jerk values obtained by differentiation of the rotation acceleration, especially the peak amount J1 of the leading edge of the rotation acceleration and the peak amount J3 of the trailing edge of the rotation acceleration (t1, t2), become large. As a result, a large impact is generated when the rotary body 4 starts the acceleration and the deceleration, which is not preferable. In short, a small peak amount of the jerk value like the jerk values shown in other zones contributes to reduction of the impact.

Figure 4:
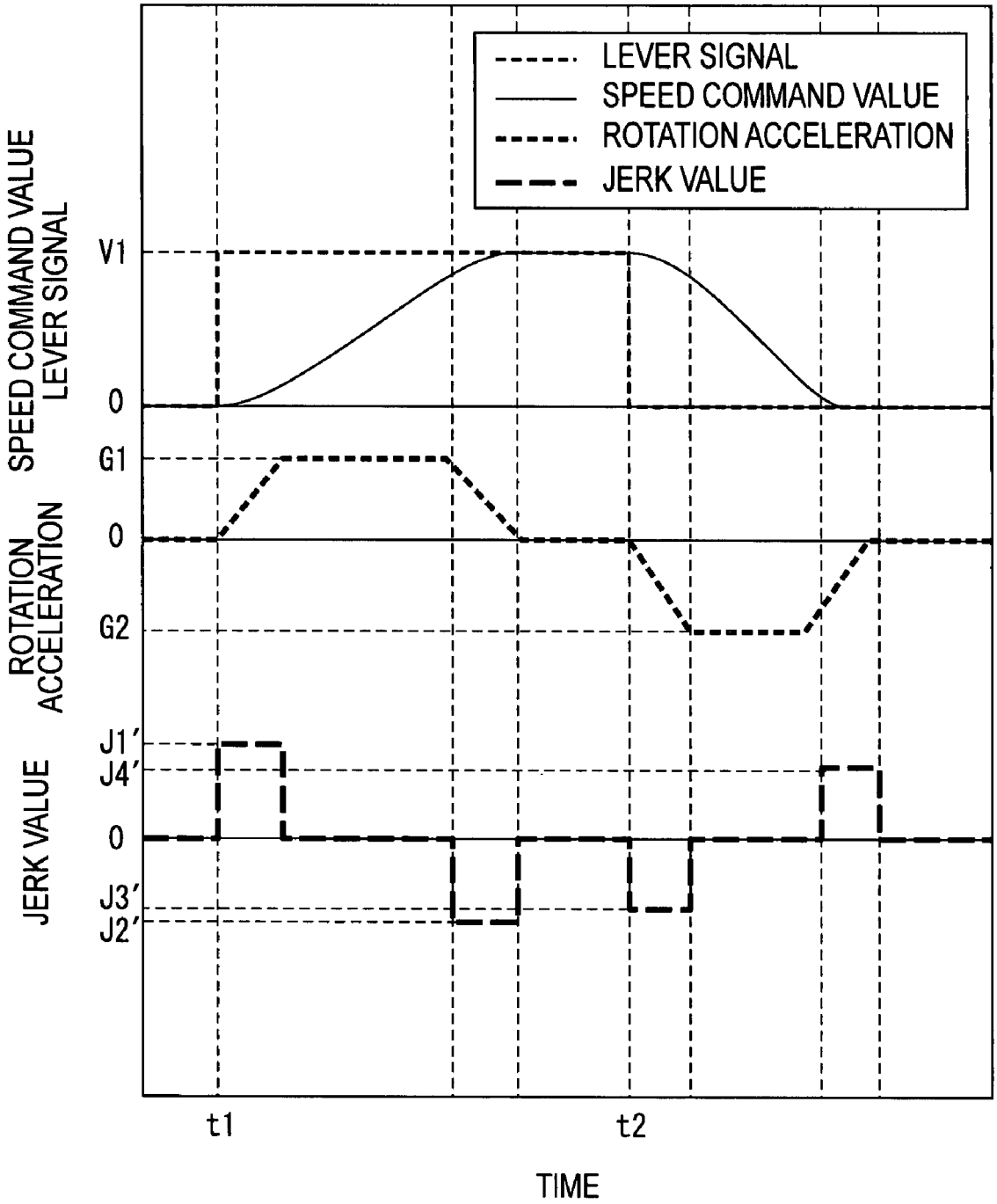
FIG. 4 is a diagram explaining a rotation control method according to the first embodiment.

As shown in FIG. 4, the swing control device 50 of the first embodiment is so designed that by defining a gradient of the torque output to provide gradients to the leading edge and the trailing edge of the rotation acceleration, peak amounts J1' to J4' of the jerk values are decreased, thereby reducing the impact in starting the acceleration and the deceleration. Specifically, a target rotation acceleration for rotating the rotary body 4 at such a rotation acceleration is calculated and a speed command value following the target rotation acceleration is generated, thereby defining the gradient of the torque output via a command of a torque command value Ttar. With the arrangement, the impact in starting the acceleration and the deceleration can be reduced as compared to an arrangement in which a proportional calculator and a differentiation calculator perform PID (Proportional Integral Differential) control where a torque command value tends to increase especially in the leading edge and the trailing edge of the rotation acceleration.

Figure 5:
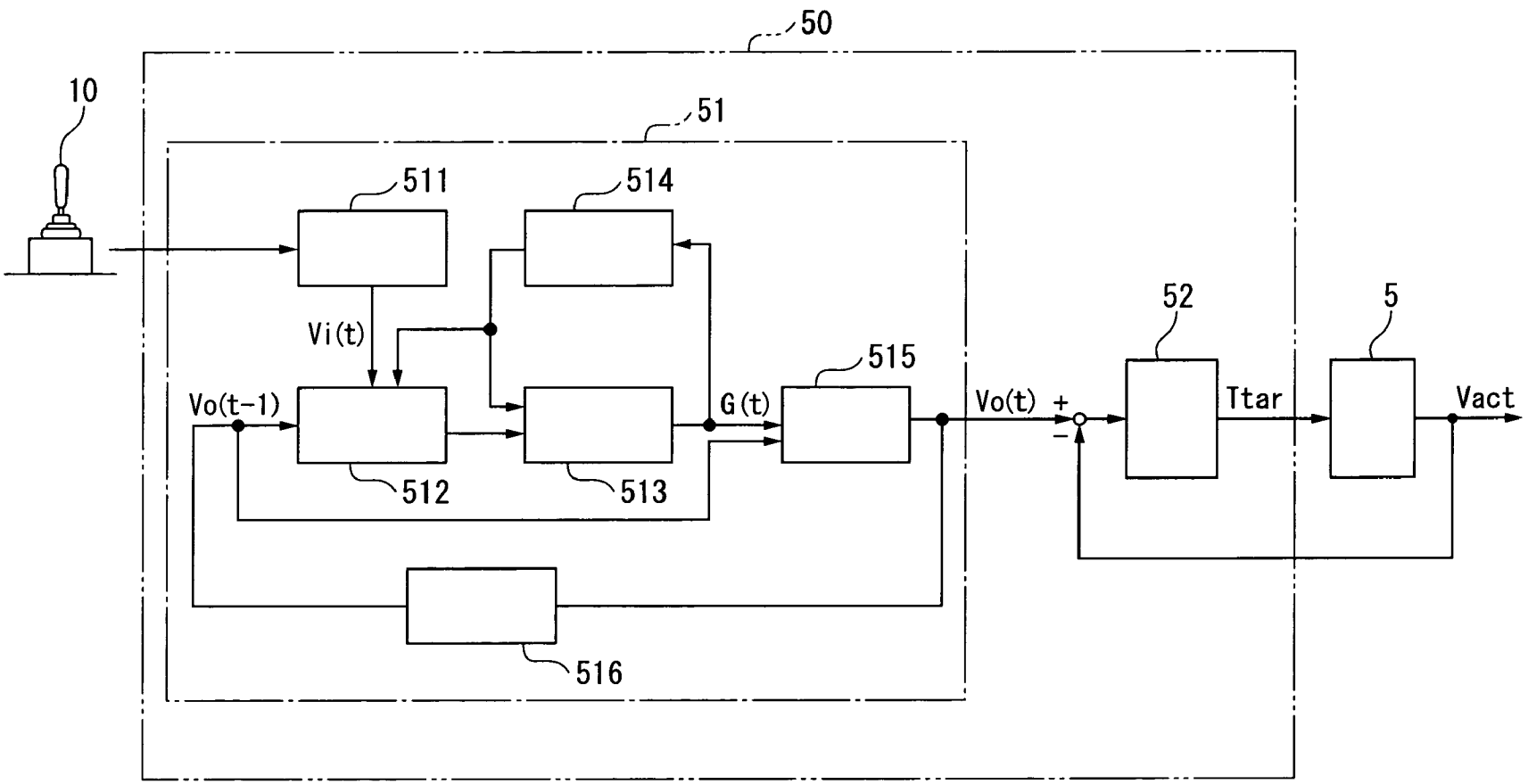
FIG. 5 is a diagram explaining a swing control device installed in the construction machine according to the first embodiment.

As shown in FIG. 5, the swing control device 50 includes a speed-command-value generating means 51 and a torque-command-value generating means 52.

The speed-command-value generating means 51 generates a speed command value Vo(t) for the electric motor 5 based on the lever signal value and a fed-back preceding speed command value Vo(t−1) in order to rotate the rotary body 4 at a targeted rotation acceleration. For this purpose, the speed-command-value generating means 51 includes a lever-command-speed-value generating means 511, a region judging section 512, a target acceleration calculator 513, a target acceleration storage section 514, a speed-command-value generator 515 and a speed-command-value storage section 516.

The lever-command-speed-value generating means 511 converts the lever signal value to a speed to generate a lever command speed value Vi(t), which is output to the region judging section 512. The lever command speed value Vi(t) is a reference value of the speed command value Vo(t), the speed command value Vo(t) and basically a value obtained by filtering or limiting a change amount of the lever command speed value Vi(t). In the first embodiment, the lever signal value and the lever command speed value Vi(t) are proportional to each other.

The region judging section 512 judges which region (i.e., the acceleration operation, the stop deceleration operation or the intermediate deceleration operation) the rotation state of the rotary body 4 falls into based on a relationship between the preceding speed command value Vo(t−1) and the lever command speed value Vi(t) and a relationship between a preceding target rotation acceleration G(t−1) and a predetermined maximum rotation acceleration Ga_max, Gb_max. In the description, the acceleration operation refers to a state in which the swing lever 10 is tilted from a neutral position by a predetermined angle. The stop deceleration operation refers to a state in which the swing lever 10 tilted by a predetermined tilt angle is returned to the neutral position, and the intermediate deceleration operation refers to a state in which the swing lever 10 tilted by a predetermined angle is returned to an arbitrary position before the neutral position.

Figure 6:
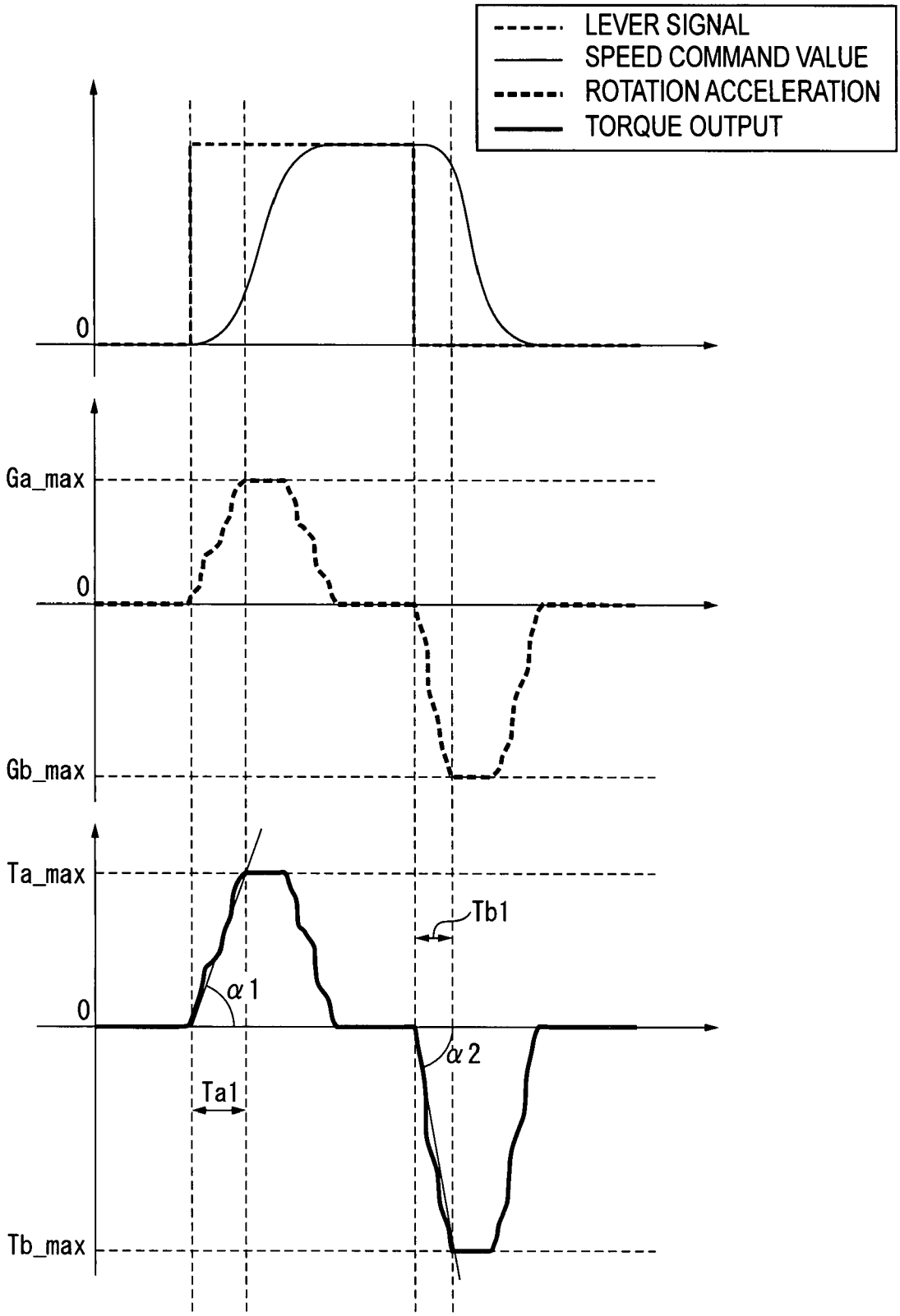
FIG. 6 is a diagram explaining in more detail the rotation control method according to the first embodiment.

The target acceleration calculator 513 calculates a value of the target rotation acceleration G(t) in accordance with the judgment result of the region judging section 512. As shown in FIG. 6, in the acceleration operation, the target acceleration calculator 513 calculates the target rotation acceleration G(t) such that a rise time Ta1 required when the torque output reaches from zero to the maximum torque output Ta_max becomes 0.15 seconds or more. Based on the calculation, a gradient is provided to the leading edge of the torque output (α1). With the leading time shorter than 0.15 seconds, the impact in the acceleration operation may not be securely suppressed.

In the deceleration, the target acceleration calculator 513 calculates the target rotation acceleration G(t) such that a fall time Tb1 required when the torque output reaches from zero to the maximum torque output Tb_max becomes 0.1 seconds or more. Based on the calculation, a gradient is provided to the trailing edge of the torque output (α2). With the fall time shorter than 0.1 seconds, the impact becomes large, which gives uncomfortableness to an operator.

Figure 7:
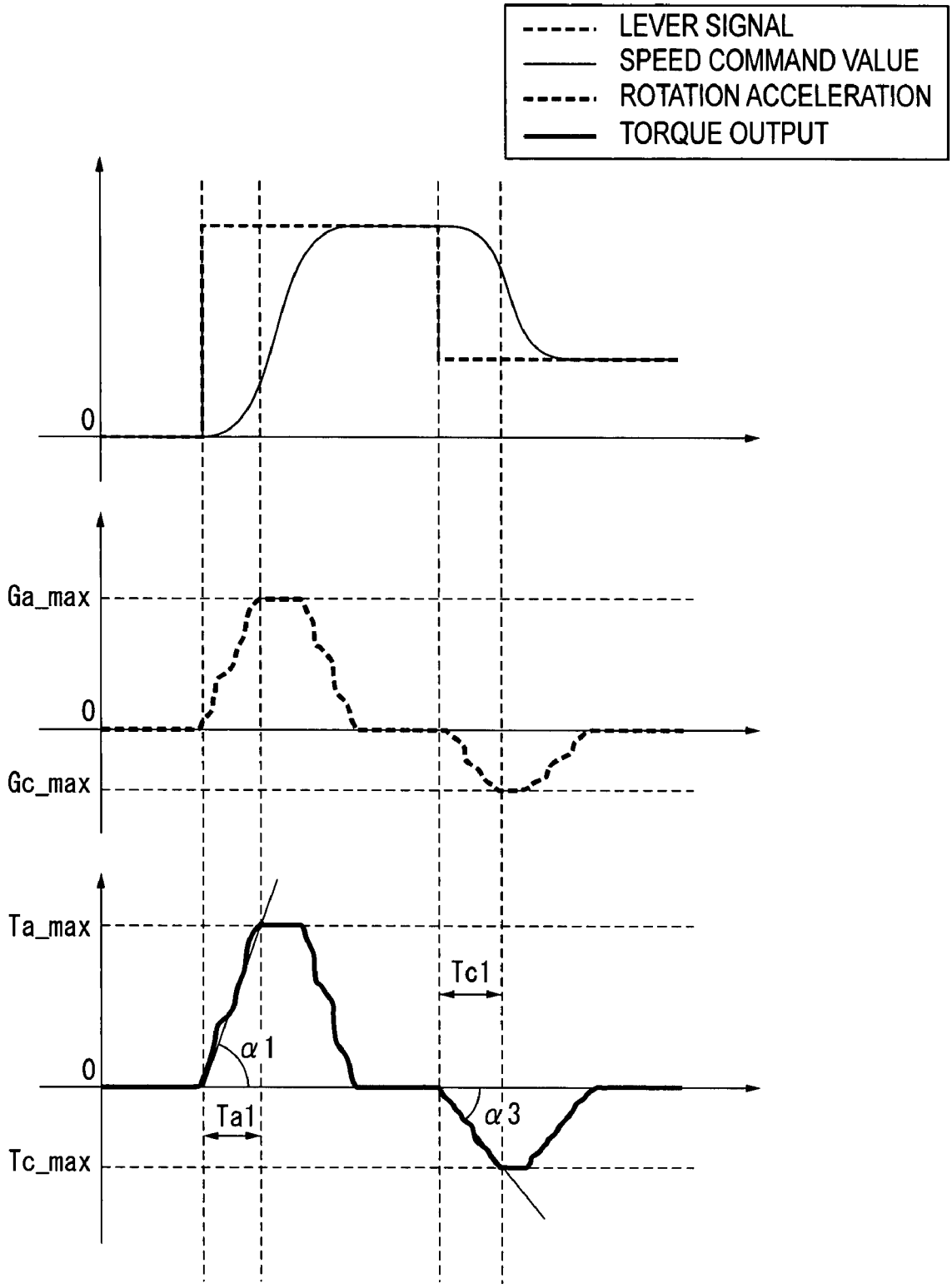
FIG. 7 is a diagram explaining in more detail another rotation control method according to the first embodiment.

As shown in FIG. 7, in the intermediate deceleration operation, the target acceleration calculator 513 calculates the target rotation acceleration G(t) such that a fall time Tc1 required when the torque output reaches from zero to the maximum torque output Tc_max becomes 0.15 seconds or more. Based on the calculation, a gradient is provided to the trailing edge of the torque output (α3). With the fall time Tc1 shorter than 0.15 seconds, the impact unique to the intermediate deceleration operation may not be sufficiently suppressed.

Figure 8:
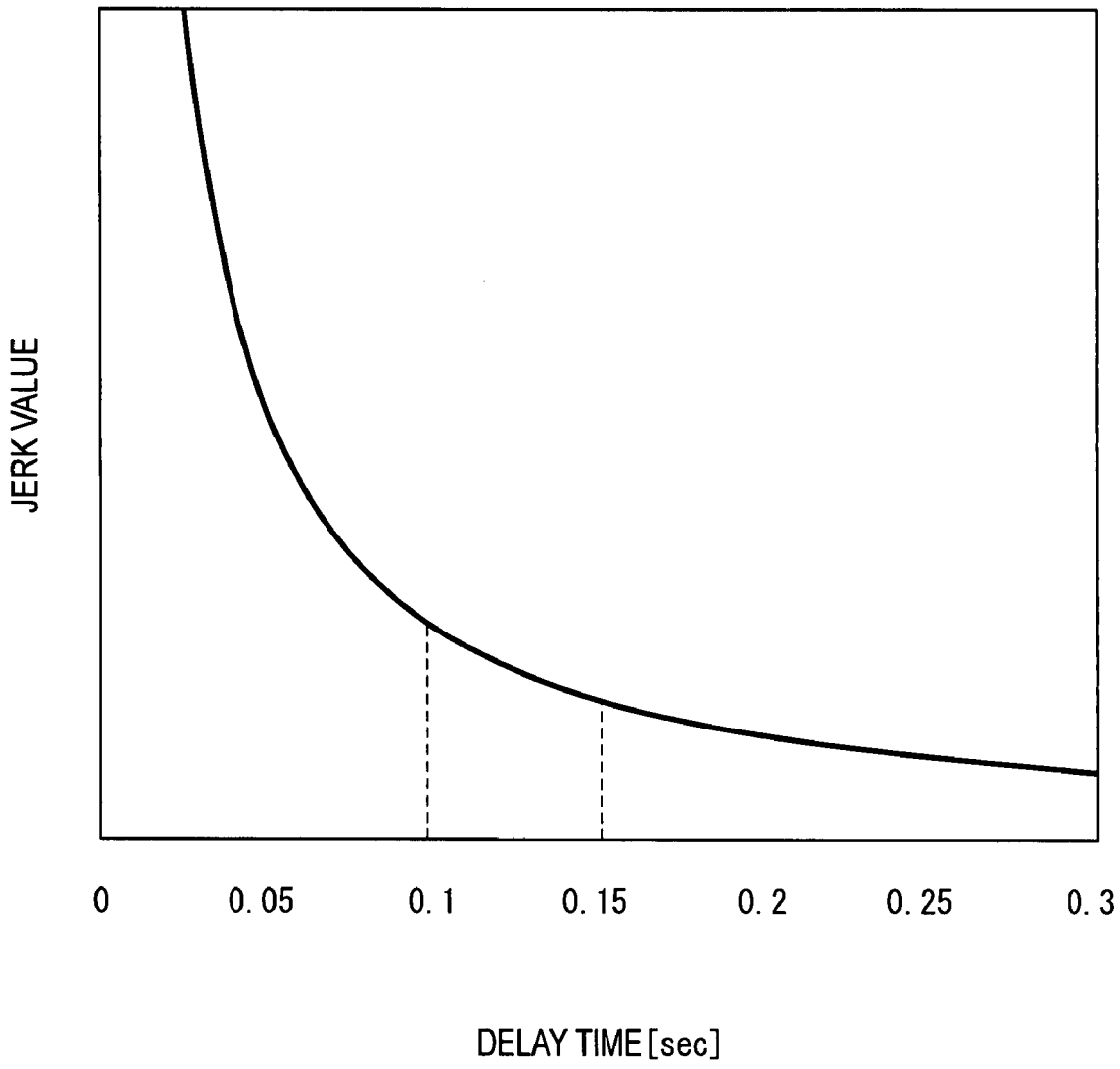
FIG. 8 is a graph showing a relationship between a delay time and a jerk value.

FIG. 8 shows a relationship between delay times such as the rise time Ta1 and the fall times Tb1, Tc1 and the jerk value. As seen in the figure when the delay time is less than 0.1 seconds, the jerk value increases sharply and the impact becomes large. Accordingly, in the stop deceleration operation having the shortest fall time Tb1, it is preferable to provide the gradient of 0.1 second or more. When the rotary body 4 in a stop state is accelerated, a larger impact is expected, so that the rise time Ta1 is preferably 0.15 seconds or more. In addition, in the intermediate deceleration operation that requires a small operation amount of the swing lever 10, a gentle deceleration is required as compared to the stop deceleration operation, so that the fall time Tc1 is preferably 0.15 seconds or more.

In the first embodiment, as shown in FIGS. 6 and 7, the maximum rotation accelerations Ga_max, Gb_max (FIG. 6) and Gc_max (FIG. 7) having different magnitudes are set respectively for the acceleration operation, stop deceleration operation and intermediate deceleration operation. Specifically, an absolute value of the maximum rotation acceleration Gb_max in the stop deceleration operation shown in FIG. 6 is set to largest in these maximum rotation accelerations Ga_max, Gb_max and Gc_max, whereby the maximum torque output Tb_max output in the stop deceleration operation can also be increased and responsivity in stopping can be enhanced. <0}

On the other hand, an absolute value of the maximum rotation acceleration Gc_max in the intermediate deceleration operation shown in FIG. 7 is set to smallest, the maximum rotation acceleration Gc_max being a value different from the maximum rotation acceleration Gb_max in the stop deceleration operation in FIG. 6. Accordingly, the maximum torque output Tc_max output in the intermediate deceleration operation can be decreased, whereby the rotary body 4 can be decelerated gently.

Referring back to FIG. 5, the target acceleration storage section 514 stores the target rotation acceleration G(t) calculated by the target acceleration calculator 513. The stored value is used by the region judging section 512 and the target acceleration calculator 513 as the preceding target rotation acceleration G(t−1) in the next calculation.

The speed-command-value generator 515 generates speed command value Vo(t) such that the change amount from the fed-back preceding speed command value Vo(t−1) becomes equal to the value of the target rotation acceleration G(t) calculated by the target acceleration calculator 513. Specifically, the speed-command-value generator 515 adds a value obtained by multiplying the target rotation acceleration G(t) by a time period of a calculation step to the preceding speed command value Vo(t−1) to generate the speed command value Vo(t).

The speed-command-value storage section 516 stores the speed command value Vo(t) generated by the speed-command-value generating means 51. The stored value is used by the region judging section 512 and the speed-command-value generator 515 as the preceding speed command value Vo(t−1) in the next calculation.

The torque-command-value generating means 52 generates the torque command Ttar in accordance with a deviation between the current speed command value Vo(t) generated by the speed-command-value generator 515 of the speed-command-value generating means 51 and the fed-back actual speed Vact. Accordingly, when the actual speed Vact does not increase relative to the speed command value Vo(t), the torque-command-value generating means 52 performs a control such that the torque output is increased so as to increase the actual speed Vact to be close to the target speed. Note that such control is a speed control performed by a typical P (Proportional) control.

[1-3] Control Operation of Rotation Control Device 50

Next, a control operation of the swing control device 50, specifically how the speed-command-value generating means 51 calculates and outputs the speed command value Vo(t) based on the input lever signal, will be described with reference to FIGS. 9 and 10 and Equations below. Note that control operation in the acceleration operation and the stop deceleration operation will be representatively described referring to FIGS. 9 and 10. In the intermediate deceleration operation, the speed command value is calculated in a manner similar to the stop deceleration operation, which is easily understood from the description of the stop deceleration operation, so that the description of the intermediate deceleration operation will be omitted. Note that in FIG. 9 and Equations shown below, "Ga", "Gb" respectively represent the maximum rotation accelerations Ga_max, Gb_max in FIGS. 6 and 7.

Figure 9:
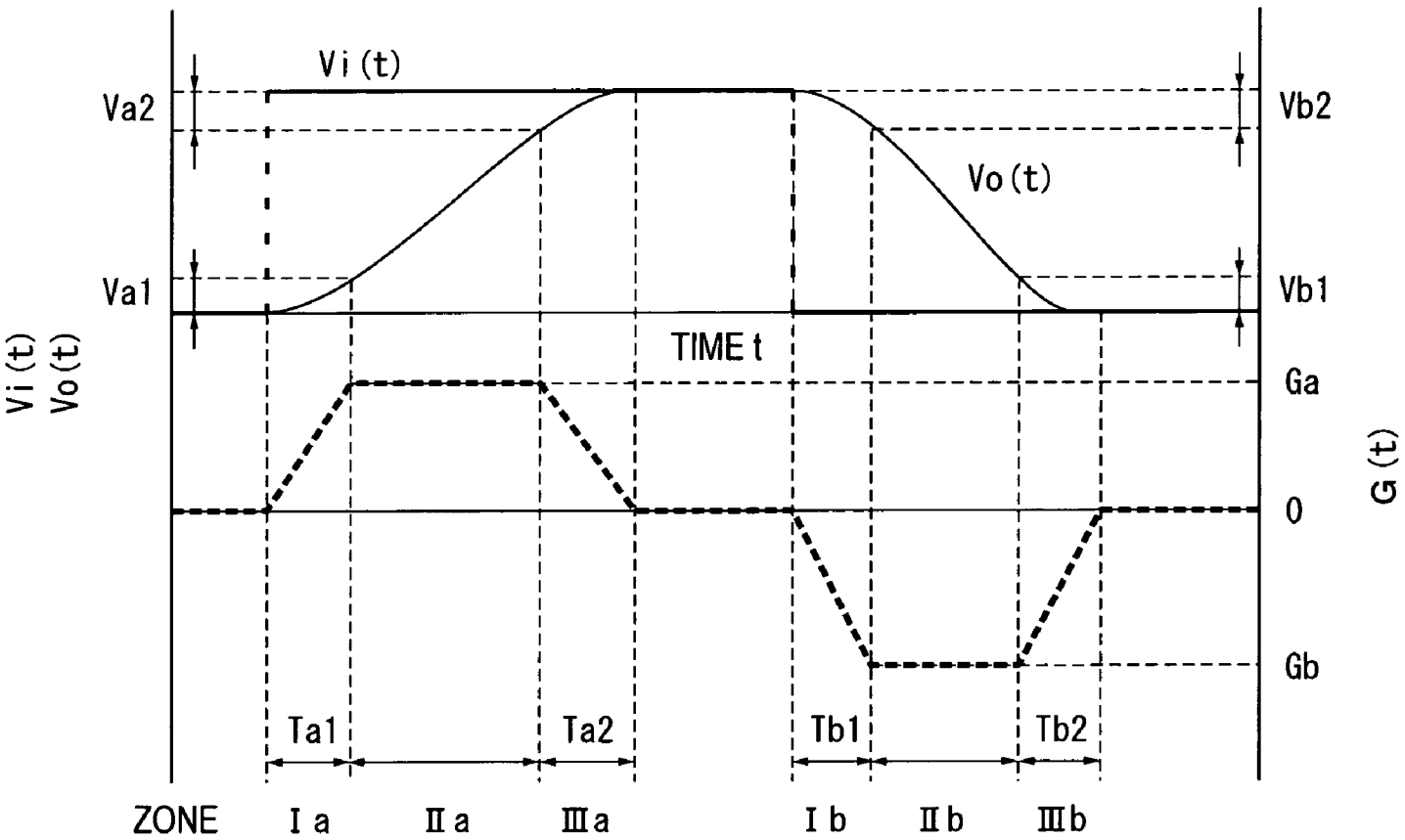
FIG. 9 is a diagram explaining how a speed command value is calculated in the first embodiment.

In FIG. 9, when an operator tilts the swing lever 10 to rotate the rotary body 4, first, the swing control device 50 reads a current lever signal value and then the lever-command-speed-value generating means 511 of the speed-command-value generating means 51 converts the lever signal value to a speed to generate the lever command speed value Vi(t) (ST1).

When receiving the lever command speed value Vi(t), the region judging section 512 performs region judgment based on a plurality of judgment conditions. Specifically, the region judging section 512 first judges whether or not the current lever command speed value Vi(t) is larger than the preceding speed command value Vo(t−1) (ST2). From this judgment, it is determined whether the rotary body 4 is rotated in an acceleration region or in a deceleration region.

When the current lever command speed value Vi(t) is judged to be larger than the preceding speed command value Vo(t−1), the region judging section 512 judges whether or not a value obtained by subtracting the preceding speed command value Vo(t−1) from the current lever command speed value Vi(t) is larger than a predetermined value Va2 (ST3) and then judges whether or not a preceding target rotation acceleration G(t−1) is smaller than the maximum rotation acceleration Ga (ST4).

Figure 10:
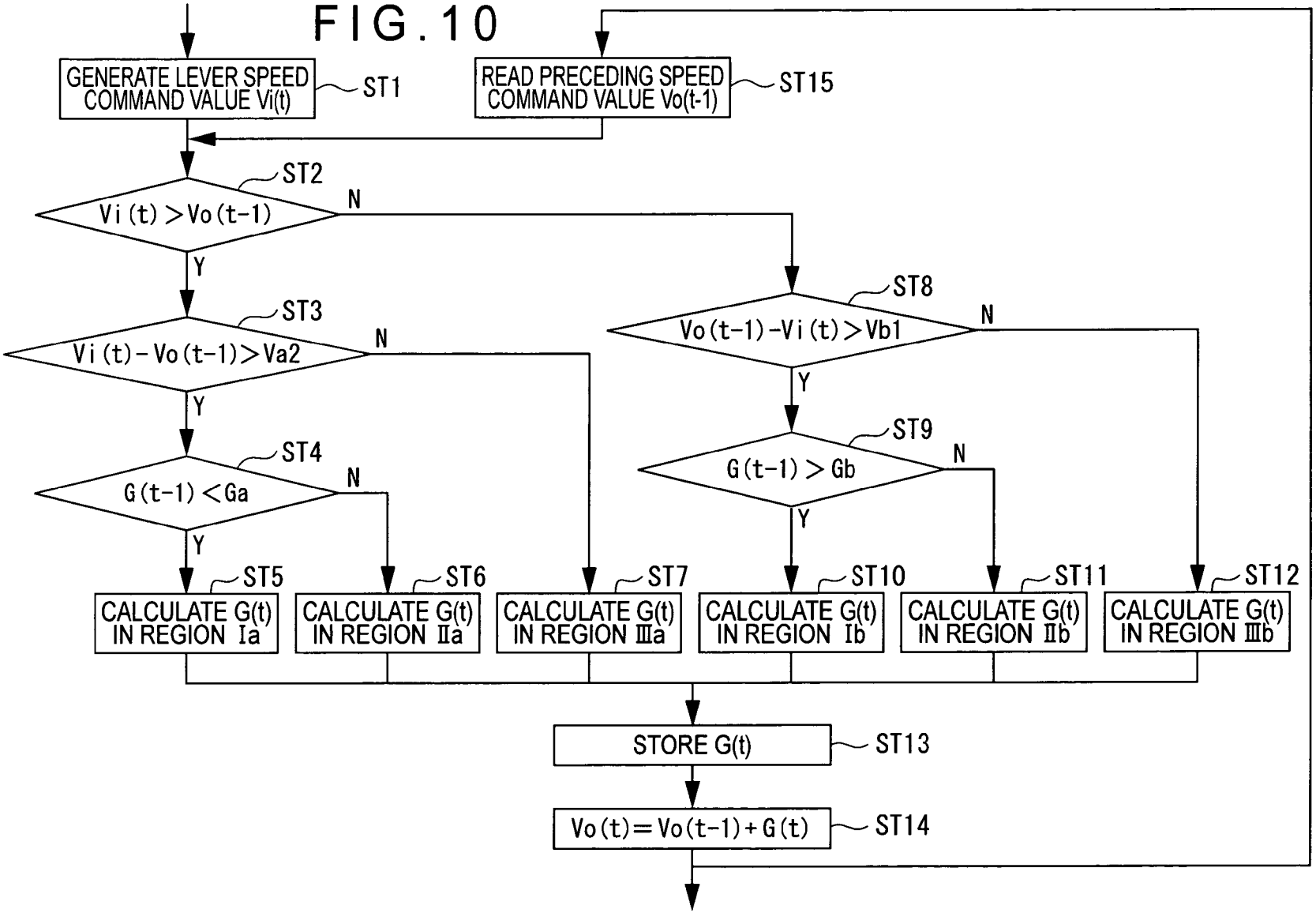
FIG. 10 is a flowchart explaining how the speed command value is calculated.

Specifically, in FIG. 10, in the acceleration region, when the value obtained by subtracting from the current lever command speed value Vi(t) the preceding speed command value (i.e., the speed command value Vo(t−1) at a preceding calculation step) is larger than the predetermined value Va2 and the preceding target rotation acceleration G(t−1) is smaller than the maximum rotation acceleration Ga, it is judged that the rotary body 4 is rotated in a region Ia. When a difference between the lever command speed value Vi(t) and the speed command value Vo(t−1) is larger than the predetermined value Va2 and the target rotation acceleration G(t−1) is equal to or larger than the maximum rotation acceleration Ga, it is judged the rotary body 4 is rotated in a region IIa. When a difference between the lever command speed value Vi(t) and the speed command value Vo(t−1) is equal to or smaller than the predetermined value Va2, it is judged that the rotary body 4 is rotated in a region IIIa.

Next, referring back to FIG. 9, the target acceleration calculator 513 calculates the target rotation acceleration G(t) using Equations (1) to (3) for each judgment region (ST5 to ST7). At this time, values Ja1, Ja2 respectively corresponding to the jerk values are obtained by Equation (4).

$$\mathrm{I}\,a: G_{(t)} = G_{(t-1)} + J_{a1} \cdot \mathrm{step} \tag{1}$$

$$\mathrm{II}\,a: G_{(t)} = Ga \tag{2}$$

$$\mathrm{III}\,a: \text{SMALLER ONE OF} \left\{ \begin{array}{l} G_{(t)} = G_{(t-1)} + J_{a1} \cdot \mathrm{step} \ \ \text{AND} \\ G_{(t)} = -J_{a2}\sqrt{\left|\dfrac{2 \cdot (Vi_{(t)} - Vo_{(t-1)})}{J_{a2}}\right|} \end{array} \right\} \tag{3}$$

$$\left( \begin{array}{l} J_{a1} = \dfrac{Ga}{T_{a1}} \\ J_{a2} = \dfrac{Ga}{T_{a2}} \\ J_{b1} = \dfrac{Gb}{T_{b1}} \\ J_{b2} = \dfrac{Gb}{T_{b2}} \end{array} \right) \tag{4}$$

On the other hand, when the current lever command speed value Vi(t) is judged to be equal to or smaller than the preceding speed command value Vo(t−1), the region judging section 512 judges whether or not a value obtained by subtracting the current lever command speed value Vi(t) from the preceding speed command value Vo(t−1) is larger than a predetermined value Vb1 (ST8) and then judges whether or not the preceding target rotation acceleration G(t−1) is larger than the maximum rotation acceleration Gb in the deceleration side (ST9).

Specifically, In FIG. 10, in deceleration regions such as in the stop deceleration operation or in the intermediate deceleration operation, when the value obtained by subtracting the current lever command speed value Vi(t) from the preceding speed command value Vo(t−1) is larger than the predetermined value Vb1 and the preceding target rotation acceleration G(t−1) is larger than the maximum rotation acceleration Gb of the deceleration side (namely the preceding target rotation acceleration G(t−1) does not reach the maximum rotation acceleration Gb), it is judged that the rotary body 4 rotates in a region Ib. When a difference between the speed command value Vo(t−1) and the lever command speed value Vi(t) is larger than the predetermined value Vb1 and the target rotation acceleration G(t−1) is equal to or smaller than the maximum rotation acceleration Gb of the deceleration side (namely, the target rotation acceleration G(t−1) reaches the maximum rotation acceleration Gb), it is judged the rotary body 4 is rotated in a region IIb. When a difference between the speed command value Vo(t−1) and the lever command speed value Vi(t) is equal to or smaller than the predetermined value Vb1, it is judged that the rotary body 4 is rotated in a region IIIb.

Next, referring back to FIG. 9, the target acceleration calculator 513 calculates the target rotation acceleration G(t) using Equations (5) to (7) for each judgment region (ST10 to ST12). At this time, values Jb1, Jb2 respectively corresponding to the jerk values are obtained by Equation (4).

$$\mathrm{I}b: G_{(t)} = G_{(t-1)} + J_{b1} \cdot \mathrm{step} \tag{5}$$

$$\mathrm{II}b: G_{(t)} = Gb \tag{6}$$

$$\mathrm{III}b: \text{LARGER ONE OF} \left\{ \begin{array}{l} G_{(t)} = G_{(t-1)} + J_{b1} \cdot \mathrm{step} \ \ \text{AND} \\ G_{(t)} = -J_{b2}\sqrt{\left|\dfrac{2 \cdot (Vi_{(t)} - Vo_{(t-1)})}{J_{b2}}\right|} \end{array} \right\} \tag{7}$$

The target acceleration storage section 514 stores the target rotation acceleration G(t) thus calculated by the target acceleration calculator 513 (ST13). Thereafter, the speed-command-value generator 515 calculates the speed command value Vo(t) based on the target rotation acceleration G(t) and the preceding speed command value Vo(t−1) using Equation (8). The calculated speed command value Vo(t) is substituted with the preceding speed command value Vo(t−1), which is used in ST2 (ST15). The speed command value Vo(T) is continuously used by the torque-command-value generating means 52 to generate the torque command Ttar.

$$Vo(t)=Vo(t-1)+G(t)\cdot\mathrm{step} \tag{8}$$

As described above, by controlling the electric motor 5 at the speed command value Vo(t) obtained by Equation (8), targeted rise times Ta1, Tb2 and fall times Ta2, Tb1 are provided to the torque output and the acceleration, thereby suppressing the impact.

Note that the maximum rotation accelerations Ga, Gb are preset by taking into account a degree of impact that an operator typically feels. However, the maximum rotation accelerations Ga, Gb are in relations of Ga=Ta_max/I, Gb=Tb_max/I (I representing the inertia of the rotary body 4, Ta_max and Tb_max representing the maximum torque outputs of the electric motor 5), so that the actual maximum rotation acceleration may be changed when the inertia I changes due to extension/contraction of the boom 6 or the arm 7.

In the first embodiment, the inertia I is constantly detected and the maximum torque output Ta_max, Tb_max is controlled to increase when the inertia I increases and controlled to decrease when the inertia I decreases, thereby maintaining the actual maximum rotation acceleration to be substantially constant.

In such an arrangement, the inertia I of the rotary body 4 can be obtained, for instance, based on position information of the work equipment 9 that is acquired from an angle sensor provided to the boom 6 or the arm 7 or can be obtained from the rotation acceleration during the acceleration or deceleration and the torque output (see the above-described relational equation).

[1-4] Advantages of Embodiment

According to the first embodiment, the following advantages can be attained.

Specifically, even when the leading edge or the trailing edge of the lever signal becomes sharp due to a quick operation of the swing lever 10, the gradient as the rise time Ta1 or the fall time Tb1, Tc1 is provided to the leading edge or the trailing edge of the torque output and the acceleration that are output based on the lever signal so as to somewhat ease the edge, thereby suppressing an impact in acceleration or deceleration of the rotary body 4.

In addition, a specific gradient is provided for each of the acceleration operation, the stop deceleration operation and the intermediate deceleration operation, which can securely cope with difference in magnitudes of impact among the operations or a problem unique to an operation.

Specifically, by providing the gradient in the acceleration operation such that the rise time Ta1 becomes 0.15 seconds or more, the impact generated in the acceleration can be securely suppressed; by providing the gradient in the stop deceleration operation such that the fall time Tb1 becomes 0.1 seconds or more, the impact generated in the stop deceleration operation can be securely suppressed; and by providing the gradient in the intermediate deceleration operation such that the fall time Tc1 becomes 0.15 seconds or more, the impact unique to the intermediate deceleration operation can be securely suppressed.

The value of the maximum torque output Ta_max, Tb_max is variable depending on the inertia I. Accordingly, by arranging such that the maximum torque output Ta_max, Tb_max increases when the inertia I of the rotary body 4 increases while the maximum torque output Ta_max, Tb_max decreases when the inertia I decreases, the rotary body 4 can be rotated at the maximum torque output Ta_max, Tb_max according to the inertia I of the rotary body 4, which causes the acceleration to be substantially constant and enhances ride comfort.

Second Embodiment

Figure 11:
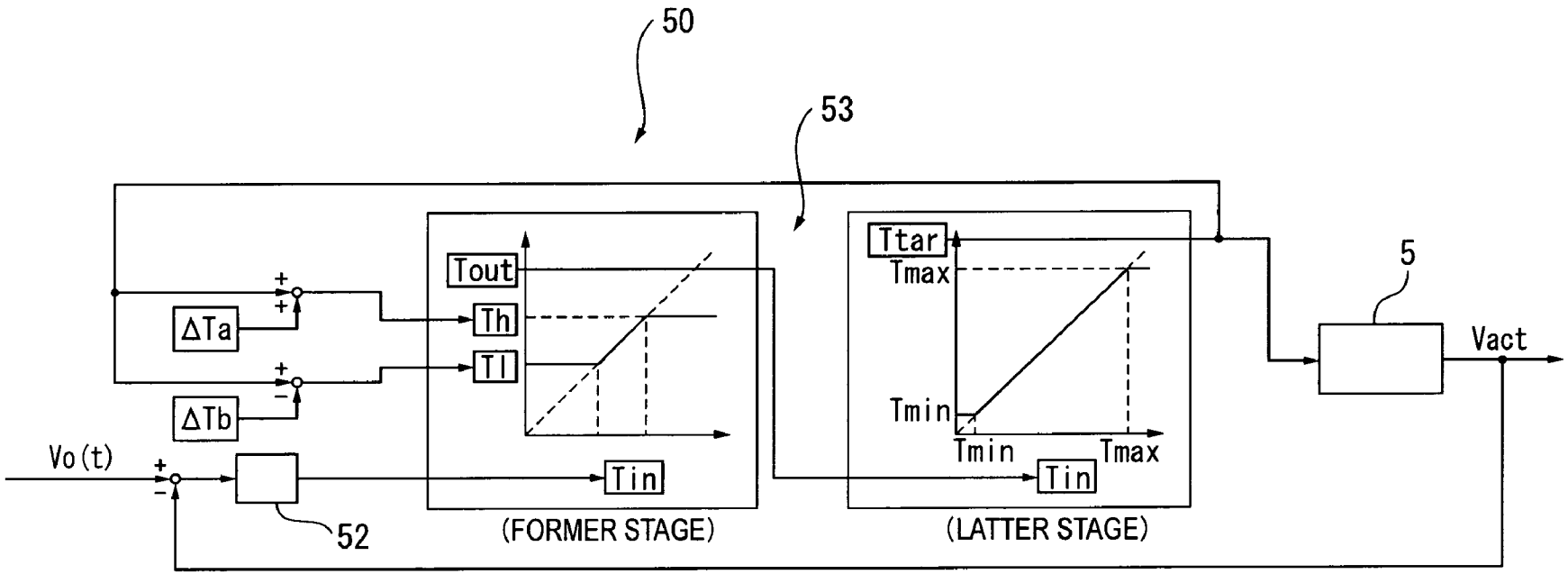
FIG. 11 is a diagram explaining a swing control device according to a second embodiment of the present invention.

FIG. 11 is a diagram explaining a swing control device according to a second embodiment of the present invention.

In the first embodiment, the target rotation acceleration reflecting the rise time Ta1 or the fall time Tb1, Tc1 is calculated based on the input lever signal and the speed command value is calculated from the target rotation acceleration, thereby obtaining the torque output and the acceleration having the targeted gradient.

In the second embodiment, a speed command value obtained from the lever signal (which is equivalent to the speed command value shown in FIG. 3 and corresponds to the actual speed without the torque limit shown in FIG. 12) is used as it is. Specifically, a value corresponding to the torque command value is temporarily generated by multiplying the speed command value obtained similarly to the related art by a speed gain. Then, a torque limit having a predetermined fluctuation range and a torque limit with its maximum value restricted are set to this generated value and the torque output is controlled within this range, thereby providing a targeted gradient. The torque limits are set by a torque limit setting means 53 of the swing control device 50.

Figure 12:
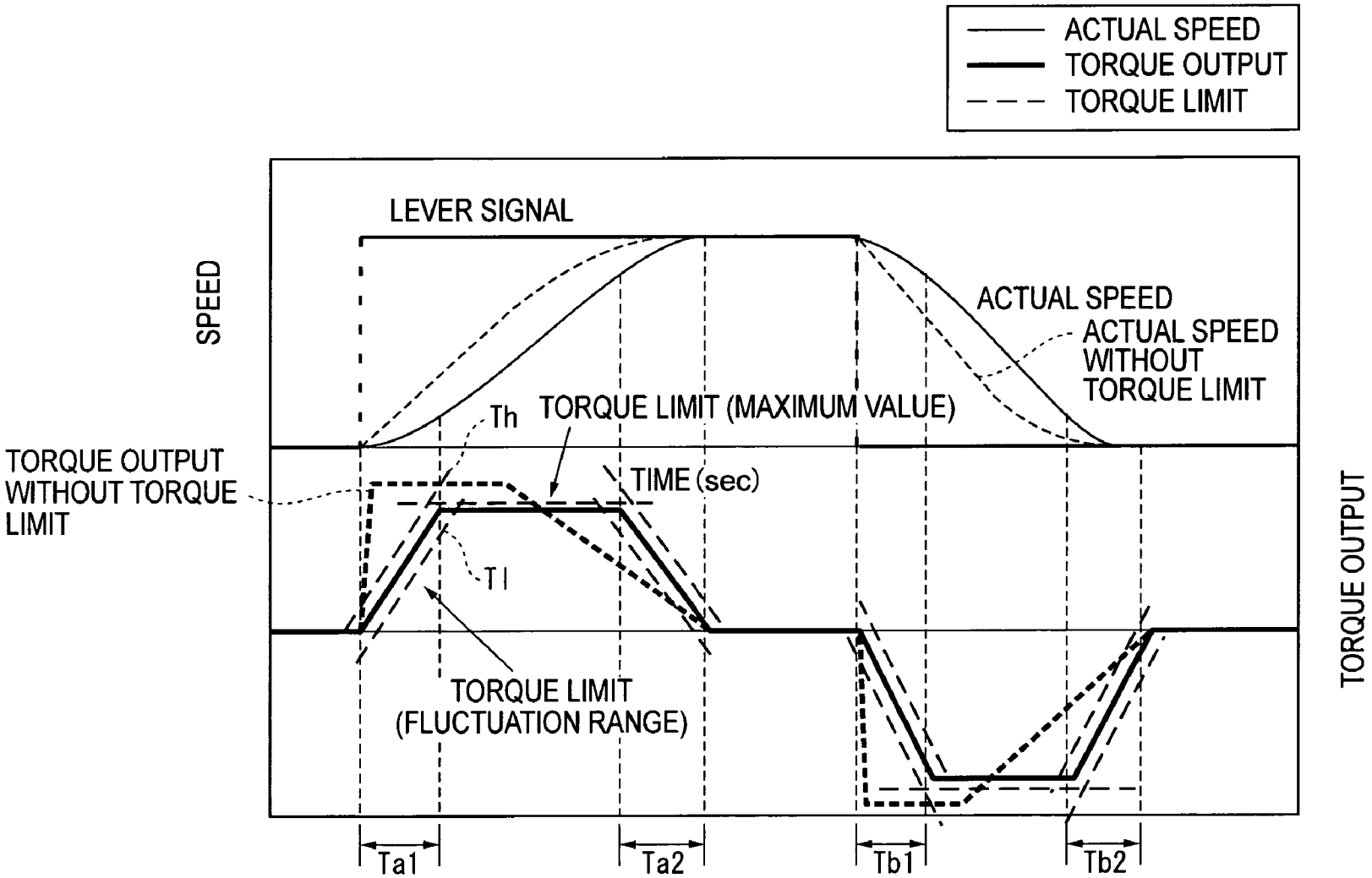
FIG. 12 is a diagram explaining a rotation control method according to the second embodiment.

In FIGS. 11 and 12, especially in the region Ta1 of the acceleration operation, the torque limit setting means 53 sets a torque limit Th on a high output side and a torque limit Tl on a low output side in a former stage of the torque limit setting so as to obtain the rise time Ta1 similar to that of the first embodiment (0.15 seconds or more), and an input value Tin as the temporarily generated torque command value is forcibly compensated so as to be output within this range (Tout). When the compensated torque command value Tout exceeds a separately set torque limit Tmax in a latter stage of the torque limit setting, the torque command value Tout is output to the electric motor 5 side (inverter) as the torque command value Ttar with the torque limit Tmax being the maximum value. The torque command output to the electric motor 5 side is fed back to the former stage. Then, ΔTa is added to the torque command value Tout and ΔTb is subtracted from the torque command value Tout in order to shift the torque limits Th, Tl in the former stage with a predetermined gradient. The torque limit Tmax in the latter stage is variable depending on the inertia I of the rotary body 4 similarly to the first embodiment.

The above-described control is also performed in the regions Ta2, Tb1, Tb2, though the description thereof is omitted.

The second embodiment also provides advantages in which the targeted gradient is provided to the torque output and the impact can be securely suppressed even when the swing lever 10 is quickly operated.

It should be noted that the present invention is not limited to the embodiments described above, but includes other components or the like that can achieve an object of the present invention, and also includes modifications as shown below. It should be noted that, while the present invention has been described with reference to the specific embodiments and the drawings thereof, various modifications may be made to the described embodiments by those of ordinary skill in the art without departing from a spirit and a scope of the object of the invention.

Industrial Applicability

The present invention is applicable to various construction machines in which a rotary body is rotated by an electric motor.

The invention claimed is:

1. A swing control device that controls a rotary body rotated by an electric motor, comprising:

a speed-command-value generator which generates a speed command value for the electric motor based on a lever signal of a swing lever, the speed-command-value generator calculating a target rotation acceleration using a delay time obtained by providing a predetermined gradient to a leading edge and a trailing edge of a torque output of the electric motor and generating the speed command value so that the rotary body is rotated by the calculated target rotation acceleration.

2. The swing control device according to claim 1, wherein gradients having different magnitudes are provided in each of an acceleration operation a stop deceleration operation, and an intermediate deceleration operation of the rotary body.

3. The swing control device according to claim 2, wherein a maximum acceleration having different magnitudes is provided in each of the acceleration operation, the stop deceleration operation, and the intermediate deceleration operation of the rotary body.

4. The swing control device according to claim 1, wherein a maximum acceleration having different magnitudes is provided in each of an acceleration operation, a stop deceleration operation, and an intermediate deceleration operation of the rotary body.

5. A construction machine, comprising:

a rotary body that is rotated by an electric motor; and the swing control device of claim 1.

6. A swing control device that controls a rotary body rotated by an electric motor, wherein:

the swing control device provides a predetermined gradient to a leading edge and a trailing edge of a torque output of the electric motor based on a lever signal from a swing lever, gradients having different magnitudes are provided in each of an acceleration operation, a stop deceleration operation, and an intermediate deceleration operation of the rotary body, the gradient for the leading edge of the torque output in the acceleration operation is provided such that a rise time required when the torque output reaches a maximum value from zero becomes 0.15 seconds or more, the gradient for the trailing edge of the torque output in the stop deceleration operation is provided such that a fall time required when the torque output reaches a maximum value from zero becomes 0.10 seconds or more, and the gradient for the trailing edge of the torque output in the intermediate deceleration operation is provided such that a fall time required when the torque output reaches a maximum value from zero becomes 0.15 seconds or more.

7. The swing control device according to claim 6, wherein:

a maximum acceleration having different magnitudes is provided in each of the acceleration operation, the stop deceleration operation, and the intermediate deceleration operation of the rotary body.

8. A swing control device that controls a rotary body rotated by an electric motor, wherein:

the swing control device provides a predetermined gradient to a leading edge and a trailing edge of a torque output of the electric motor based on a lever signal from a swing lever, a maximum acceleration having different magnitudes is provided in each of an acceleration operation, a stop deceleration operation, and an intermediate deceleration operation of the rotary body, the gradient for the leading edge of the torque output in the acceleration operation is provided such that a rise time required when the torque output reaches a maximum value from zero becomes 0.15 seconds or more, the gradient for the trailing edge of the torque output in the stop deceleration operation is provided such that a fall time required when the torque output reaches a maximum value from zero becomes 0.10 seconds or more, and the gradient for the trailing edge of the torque output in the intermediate deceleration operation is provided such that a fall time required when the torque output reaches a maximum value from zero becomes 0.15 seconds or more.

* * * * *